US006413363B1

(12) United States Patent
Hsu et al.

(10) Patent No.: US 6,413,363 B1
(45) Date of Patent: Jul. 2, 2002

(54) METHOD OF MAKING ABSORBENT TISSUE FROM RECYCLED WASTE PAPER

(75) Inventors: Jay C. Hsu, Alpharetta; Nauman N. Lakhani, Woodstock, both of GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/608,836

(22) Filed: Jun. 30, 2000

(51) Int. Cl.[7] ..... D21H 11/14; D21B 1/32

(52) U.S. Cl. ..... 162/4; 162/5; 162/55; 162/123; 162/125; 162/132

(58) Field of Search ..... 162/4, 5, 55, 123, 162/125, 129, 130, 132

(56) References Cited

U.S. PATENT DOCUMENTS

| | | | |
|---|---|---|---|
| 3,598,696 | A | 8/1971 | Beck |
| 3,695,985 | A | 10/1972 | Brock et al. |
| 3,903,342 | A | 9/1975 | Roberts, Jr. |
| 3,953,638 | A | 4/1976 | Kemp |
| 4,075,382 | A | 2/1978 | Chapman et al. |
| 4,100,017 | A | 7/1978 | Flautt, Jr. |
| 4,113,911 | A | 9/1978 | LaFitte et al. |
| 4,145,464 | A | 3/1979 | McConnell et al. |
| 4,166,001 | A | 8/1979 | Dunning et al. |
| 4,196,245 | A | 4/1980 | Kitson et al. |
| 4,207,367 | A | 6/1980 | Baker, Jr. |
| 4,239,792 | A | 12/1980 | Ludwa |
| 4,287,251 | A | 9/1981 | King et al. |
| 4,298,649 | A | 11/1981 | Meitner |
| 4,326,000 | A | 4/1982 | Roberts, Jr. |
| 4,377,615 | A | 3/1983 | Suzuki et al. |
| 4,436,780 | A | 3/1984 | Hotchkiss et al. |
| 4,445,974 | A | 5/1984 | Stenberg |
| 4,469,735 | A | 9/1984 | Trokhan |
| 4,537,822 | A | 8/1985 | Nanri et al. |
| 4,548,856 | A | 10/1985 | Khan et al. |
| 4,610,915 | A | 9/1986 | Crehshaw et al. |
| 4,618,524 | A | 10/1986 | Groitzsch et al. |

(List continued on next page.)

OTHER PUBLICATIONS

PCT International Publication No. WO 96/00811, International Publication Date: Jan. 11, 1996.
PCT International Application No. PCT/US95/08168, International Application Filing Date: Jun. 28, 1995.
PCT International Publication No. WO 97/15711, International Publication Date: May 1, 1997.
PCT International Application No. PCT/US96/16477, International Application Filing Date: Oct. 15, 1996.
PCT International Publication No. WO 98/23813, International Publication Date: Jun. 4, 1998.
PCT International Application No. PCT/US97/21427, International Application Filing Date: Nov. 25, 1997.
PCT International Publication No. WO 98/23814, International Publication Date: Jun. 4, 1998.
PCT International Application No. PCT/US97/22238, International Application Filing Date: Nov. 25, 1997.

*Primary Examiner*—Dean T. Nguyen
(74) *Attorney, Agent, or Firm*—Dority & Manning, P.A.

(57) ABSTRACT

A product and process of making an absorbent paper article such as paper products, towels, napkins and the like is disclosed. In the invention, one may supply a single furnish, or slurry, of cellulose fibers. Then, it is possible to separate or fractionate the slurry into at least two portions based upon fiber length in the slurry. Fines are employed in the process of manufacturing the products, and fines are specifically incorporated into an inner layer of the final paper products. Fines, short fibers, and/or fibrils are used in the process so they may contribute in a positive manner to the final paper product, rather than acting in a negative manner as a chemical "sponge" or waste material. This use of fines in the inner layers of the product reduces the manufacturing cost and waste produced in the process. A soft paper product with good strength characteristics results from the process.

15 Claims, 1 Drawing Sheet

U.S. PATENT DOCUMENTS 4,781,793 A * 11/1988 Halme ..... 162/55
4,816,320 A 3/1989 Cyr
4,885,202 A 12/1989 Lloyd et al.
5,087,324 A 2/1992 Awofeso et al.
5,192,388 A 3/1993 Schöllkopf et al.
5,228,954 A * 7/1993 Vinson et al. ..... 162/100
5,399,412 A 3/1995 Sudall et al.
5,543,202 A 8/1996 Clark et al.
5,582,681 A 12/1996 Back et al.
5,607,551 A 3/1997 Farrington, Jr. et al.
5,616,207 A 4/1997 Sudall et al.
5,620,565 A 4/1997 Lazorisak et al.
6,001,218 A 12/1999 Hsu et al.
6,024,834 A 2/2000 Horton , Jr. et al.
6,027,610 A * 2/2000 Back et al. ..... 162/111
6,080,266 A 6/2000 Horton, Jr. et al. ..... 156/300
6,248,210 B1 * 6/2001 Edwards et al. ..... 162/111

* cited by examiner

METHOD OF MAKING ABSORBENT TISSUE FROM RECYCLED WASTE PAPER

BACKGROUND OF THE INVENTION

Strength and softness are important attributes in consumer paper products such as bathroom tissue, towels, and napkins. These two attributes are strongly influenced by the sheet structure of a paper product. Further, the types of fiber employed in the sheet are important factors in determining the strength and softness of products made from such fibers.

Strength and softness typically are inversely related. That is, the stronger a given sheet appears, the less soft that sheet will be. Likewise, a softer sheet is usually not as strong. Thus, it is a constant endeavor in the industry to produce a sheet having a strength which is at least as great as conventional prior art sheets, but with improved softness. Also, a sheet which is at least as soft as conventional sheets, but with improved strength, is desirable.

It is common in the manufacture of paper products to provide two furnishes or slurries of fiber. Sometimes, a two-furnish system is used in which the first furnish is comprised of eucalyptus wood fibers, and the second furnish is made of higher grade wood fibers, such as fibers from Northern softwood and the like. In general, more desirable fibers with better softness are provided in outer layers of paper products—which routinely contact the skin of consumers. The inner layers of paper products typically comprise coarse fibers which are less desirable in their properties of softness, absorbency, or strength. Thus, in this way the desirable properties of the paper products can be maximized at a minimal cost in raw materials.

The use of two separate slurries of furnish is an expensive process, and requires a relatively large amount of processing equipment. It is more difficult to rely on the supply of two different materials in the manufacture of one product. Further, it is more complex to produce a product when more than one type of raw fiber material is used in a manufacturing process.

Fractionation is the process by which cellulosic fibers are separated according to their properties. U.S. Pat. No. 6,024,834 to Horton, Jr. is directed to a process of separating by fractionation cellulosic fibers that exhibit desired properties such as fiber length and fiber coarseness values. The process has been found to produce cellulosic fibers that are more homogeneous in their properties as compared to the starting mixtures of cellulose fibers. Paper products may be prepared from fractionated cellulosic fibers for use in absorbent disposable products.

Fines and short fibers are the least desirable fibers in most fiber slurries. In the past, such fines comprised short portions of cellulosic material which do not appreciably contribute to softness. Further, such fines are too small to remain on a wire former in the papermaking process, and often fall through the wire mesh of the wire former with the water when a paper slurry is applied on the twin wire former in the early stages of paper or paper products manufacture. Further, fines comprise cellulosic particles that undesirably absorb a large amount of the treatment chemicals that are used in the headbox at the early stages of slurry formation. Thus, fines are often simply washed from the system, and may not contribute in any meaningful way to the final paper product. In fact, such fines may undesirably absorb process chemicals which otherwise could be applied to the longer fibers which in fact do become part of a paper product. In this way, fines waste processing chemicals by carrying such chemicals out of the processing system.

It would be desirable to provide a process and method which can be used to supply a single furnish of cellulose, and then produce a high quality paper product. Further, a paper products and process of making such a product in which fines, short fibers, and/or fibrils can contribute in a positive manner to the final paper product, rather than acting in a negative manner as a chemical "sponge" or waste material, would be very desirable. A method that is capable of separating a single furnish into multiple components would be valuable. Further, a process that is able to employ fines, short fibers, and long fibers in a way that provides a paper product with desirable strength and softness would be advantageous.

SUMMARY OF THE INVENTION

The present invention addresses the needs described above by providing a method of making an absorbent paper product using fines or short fibers in a new and more advantageous manner. Furthermore, a product incorporating such materials is provided by way of this invention.

The invention provides a process of making an absorbent structure comprising several steps. In one step, a cellulosic fiber mixture is provided for fractionating the first cellulosic fiber mixture into a second fiber mixture having relatively short fibers and fines, and a third fiber mixture having relatively long fibers. Then, the third fiber mixture is treated with chemical agents to soften the fibers. In a next step, the third fiber mixture is provided to a paper machine, thereby forming a paper sheet from said third fiber mixture on a wire former. Then, the step of adding the second fiber mixture to the upper surface of the paper sheet is provided.

In one embodiment of the invention, the chemical agents comprise surfactants. Further, a process is disclosed in which the chemical agents comprise enzymes. The process also may include using chemical agents that comprise debonders. The process also may provide for treatment with chemical agents that comprise surfactants and enzymes. The process also may be utilized in which the first cellulosic fiber mixture comprises recycled newspapers. The process is further provided in which a single furnish is used as a source of the cellulosic fibers.

A process is provided that includes the additional step of disposing of fines which are not incorporated into the paper sheet. A method of making sanitary paper products from newspapers containing coarse cellulose fibers is also provided. The method comprises pulping the newspapers in water with agitation to produce a pulp slurry furnish. Then, the pulp slurry furnish is fractionated into a slurry of short fibers and fines, and a slurry of long fibers is produced. The slurry of long fibers is then treated with chemical agents to soften the fibers. In an additional step, a slurry of long fibers is provided to a paper machine, thereby forming a paper sheet from said third fiber mixture on a wire former. In another step, one adds the slurry of short fibers and fines to the upper surface of the paper sheet.

In one aspect of the invention, an absorbent paper product is made by the process comprising providing a first cellulosic fiber mixture, and then fractionating the first cellulosic fiber mixture into a second fiber mixture having relatively short fibers and fines, and a third fiber mixture having relatively long fibers. Then, another step of treating the third fiber mixture with chemical agents to soften the fibers is provided. In a further step, one provides the third fiber mixture to a paper machine, thereby forming a first paper sheet from said third fiber mixture on a wire former. The first paper sheet has an upper and lower surface. The next step includes adding the second fiber mixture to the upper surface of the first paper sheet. Then, a step of drying said first paper sheet is provided. In a further step, the first paper sheet is combined with at least one additional paper sheet to form a multi-ply paper product.

In another aspect of the invention, a paper product is provided in which the multi-ply product comprises at least two layers. The paper product may comprise a tissue, towel, or napkin. The paper products may comprise one ply having two layers. The paper products also may be employed with one ply having three layers, the three layers comprising a middle layer and two outer layers. In some embodiments, the paper products includes a first paper sheet having short fibers and fines comprising the middle layer.

Paper products comprising more than one ply are shown in some aspects of the invention, wherein each ply comprises a plurality of layers, the paper products having at least one inner layer comprising short fibers and fines. In general, the inner layer is formed by providing a first cellulosic fiber mixture and then fractionating the first cellulosic fiber mixture into a second fiber mixture having relatively short fibers and fines, and a third fiber mixture having relatively long fibers.

In a further embodiment of the invention, one may treat the third fiber mixture with chemical agents to soften the fibers. In another aspect of the invention, one may provide the third fiber mixture to a paper machine, thereby forming a first paper sheet from the third fiber mixture on a wire former. The first paper sheet generally includes an upper and lower surface. In one other aspect of the invention, the second fiber mixture is added to the upper surface of the first paper sheet to form an inner layer. Then, one may combine the inner layer with other layers to form a paper product.

The paper products may comprises two plies. In some embodiments, paper products are disclosed in which the first cellulosic fiber mixture is recycled newsprint. In one aspect of the invention, the outer layers contain fibers of longer average length than the inner layers. Paper products are disclosed in which two plies are employed, each ply having two layers, wherein the chemical agent employed is a surfactant, the paper products having an increased Handfeel value.

In another aspect of the invention, the paper products are shown in which the Handfeel value at a Geometric Tensile Strength/Basis Weight of about 9 is at least about 70 or greater.

In one aspect of the invention, paper products are provided which comprise more than one ply, wherein each ply of the paper products includes a plurality of layers. The paper products also have at least one inner layer comprising short fibers and fines, the inner layer being formed in part by fractionating a single furnish of cellulose fibers into separate slurries, the respective slurries being characterized by fibers of different length, wherein a first slurry is comprised of fines. The first slurry of fines is applied upon the upper surface of a paper sheet in a papermaking machine. The paper sheet is comprised in part of relatively long fibers, and the fines adhere to the long fibers of the paper sheet. The paper sheet further is combined with other paper sheets to form paper products.

BRIEF DESCRIPTION OF THE DRAWINGS

A full and enabling disclosure of this invention, including the best mode shown to one of ordinary skill in the art, is set forth in this specification.

DETAILED DESCRIPTION OF THE INVENTION

Figure 1:
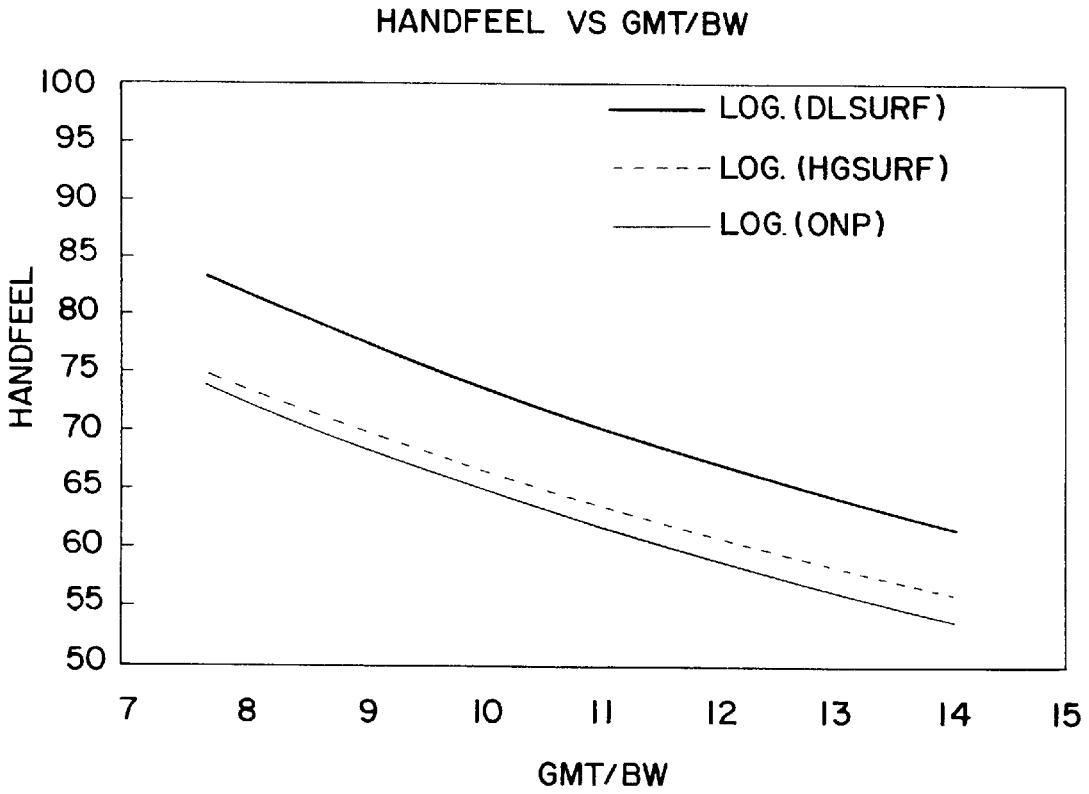
FIG. 1 is a graph providing data of Table 1 showing Handfeel softness data versus strength for various paper product samples.

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in this invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features and aspects of the present invention are disclosed in or are obvious from the following detailed description. It is to be understood by one of ordinary skill in the art that the present discussion is a description of exemplary embodiments only, and is not intended as limiting the broader aspects of the present invention, which broader aspects are embodied in the exemplary constructions.

Paper is commonly made by draining a low consistency dispersion of cellulose fiber pulp, fillers, and additives through a paper machine "wire". The "wire" or "wire former" is essentially an endless mesh or sleeve. In other processes, a multi-layer headbox is employed. In wire forming processes, however, a certain amount of solid material passes through the wire with the suspending water, and thus is not retained in the wet paper web formed on the wire. Wastepaper such as newsprint sometimes is used to form a furnish for papermaking. If it can be recycled, such wastepaper provides an inexpensive source of cellulose for paper manufacture.

Unfortunately, such paper is not as desirable as premium grades of virgin wood, and several methods and processes have been developed in attempting to render such wastepaper suitable for manufactured paper products. U.S. Pat. No. 6,001,218 to Hsu et al. is directed to a method of making sanitary paper products from newsprint. The method includes steps of pulping, agitating, adding a surfactant, thickening, and forming the treated pulp into sanitary paper products. Other patents describe production of soft paper products from high and low coarseness fibers. U.S. Pat. No. 5,620,565 to Lazorisak et al. is directed to the production of soft paper products from high and low coarseness fibers.

Processes for forming uncreped through-air dried webs are described in U.S. Pat. No. 5,779,860 to Hollenberg et al. and U.S. Pat. No. 5,048,589 to Cook et al., both of which are incorporated herein in their entireties by reference thereto. In such processes, through air drying is employed as shown in the Figures of Cook et al. As described and shown therein, a web is prepared by: (1) forming a furnish of cellulosic fibers, water, and a chemical debonder; (2) depositing the furnish on a traveling foraminous belt, thereby forming a fibrous web on top of the traveling foraminous belt; (3) subjecting the fibrous web to noncompressive drying to remove the water from the fibrous web; (4) removing the dried fibrous web from the traveling foraminous belt. The process described therein does not include creping and is, thus, referred to as an uncreped through-air drying process ("UCTAD").

In this invention, it is possible to build a multilayer base sheet structure that is capable of achieving a higher degree of softness at an equivalent strength compared to existing or known paper products. The structure of the paper products of this invention include a multilayer sheet which may be either a one ply or a two ply sheet. In most cases, the outer layers contain softer fibers and the inner layers contain fines or short fibers and fibrils which are added to the sheet for imparting tensile strength to the overall sheet structure.

In this invention, the fines or short fibers which are present in an inner layer of the paper product come from the same fiber source as that of the fibers which are present in the outer layers of the paper products. That is, in one important aspect of this invention, a single furnish is used to produce the paper product or tissues of the invention. In one method, the fines are separated from the pulp at an early stage in the process using a suitable fractionation device, which is capable of separating the short fibers (and fines) from the longer fibers in the pulp. The separation according to fiber length provides the option of pre-treating the longer fiber fraction with surfactants. In some cases, a combination of surfactants and enzymes may be used for treatment before the fiber fraction is provided to the paper machine. Once the fractionation has taken place, the longer fiber fraction may be treated with some kind of fiber modification or softening agent as needed based upon the requirements of the final product. Then, the fiber fraction may be transferred to the paper machine.

In some cases, short fibers or fines are fractionated early in the process or layered on top of the longer fibers, which are already proceeding along the top of the forming wire. In the case of a one-ply paper product sheet, another layer of longer fibers then may be placed on top of the layer containing short fibers, therefore, constructing a three layer single ply paper products sheet. In other embodiments of the invention, a two-ply sheet may be provided with the original sheet being plied together in a way that the short fibers remain on a layer exposed to the inside only, while the longer fibers are contained in a layer that is exposed to the outside. This arrangement facilitates making a multilayer sheet structure with higher tensile strength, but using only a single source or furnish of fibers by utilizing the properties of the different components which are present in the pulp.

The term "average fiber length" refers to a weighted average length of pulp fibers determined utilizing an optical fiber analyzer such as Kajaani fiber analyzer model No. FS-100 available from Kajaani Oy Electronics, Kajaani, Finland or a similar fiber analyzer. Generally speaking, the weighted average length of pulp fibers is a "length-weighted" average fiber length. According to the test procedure, a pulp sample is treated with a macerating liquid to ensure that no fiber bundles or shives are present. Each pulp sample is disintegrated in to hot water and diluted to an approximately 0.001% solution. Individual test samples are drawn in approximately 50 to 100 ml portions from the dilute solution when tested using the standard Kajaani fiber analysis test procedure. The weighted average fiber length may be expressed by the following equation:

$$\sum_{xi=o}^{K} (x_i * n_i)/n$$

where k=maximum fiber length $X_i$=fiber length $n_i$=number of fibers having length $x_i$ n=total number of fibers measured.

The term "relatively short fibers" refers to pulp and by-products of paper-making processes that contains a significant amount of short fibers and non-fiber particles. In many cases, these material may be difficult to form into paper sheets and may yield relatively tight, impermeable paper sheets or nonwoven webs. Generally speaking, relatively short fibers may have an average fiber length ranging from about 0.2 mm to about 1.0 mm as determined by an optical fiber analyzer such as, for example, a Kajaani fiber analyzer model No. FS-100 (Kajaani Oy Electronics, Kajaani, Finland). For example, relatively short fibers may have an average fiber length ranging from about 0.2 mm to 0.8 mm. As another example, relatively short fibers may have an average fiber length ranging from about 0.25 mm to 0.8 mm. Generally speaking, many of the fibrous or cellulosic components of relatively low quality recycled pulp fiber material or certain types, portions or fractions of paper-making sludge may be considered low average fiber length pulps (short fibers and non-fiber particles).

In many cases, a cellulosic fiber mixture may contain a relatively high proportion of "fines." For example, some cellulosic fiber mixtures may contain more than 40 percent "fines." The term "fines" is used to describe fiber-like particles of about 0.2 mm or less in length (generally a length weighted average length) as determined by an optical fiber analyzer such as, for example, a Kajaani fiber analyzer model No. FS-100 (Kajaani Oy Electronics, Kajaani, Finland). It is contemplated that "fines" may include some portion of ash generating materials that generate inorganic residue which remains after igniting a specimen of wood, pulp, or paper so as to remove combustible and volatile compounds.

The term "relatively long fibers" refers to pulp that contains a relatively small amount of short fibers and non-fiber particles. Generally speaking, relatively long fibers tend to yield relatively open, permeable paper sheets or nonwoven webs that are desirable in applications where absorbency and rapid fluid intake are important. Relatively long fibers may typically be formed from non-secondary (i.e., virgin) fibers or from secondary (i.e., recycled) fiber pulp or low quality non-secondary fiber pulp which has been screened to remove at least some fraction of relatively short fibers. For purposes of the present invention, relatively long fibers may have an average fiber length of from 0.8 mm to greater than about 3 mm as determined by an optical fiber analyzer such as, for example, a Kajaani fiber analyzer model No. FS-100 (Kajaani Oy Electronics, Kajaani, Finland). For example, relatively long fibers may have an average fiber length from about 0.8 mm to about 2 mm. As another example, relatively long fibers may have an average fiber length ranging from about 0.85 mm to about 2 mm.

A more efficient means of using the ingredients of pulp is provided by the invention, with the ingredients that provide the most softness appearing generally on the outside of the paper products, while the ingredients which can provide strength, but do not contribute as greatly to softness, are provided on the inner layers of the paper products. Furthermore, it is possible to reduce the overall cost of the process, and to reduce the amount of waste products provided in paper products manufacture by reducing the amount of fines that are lost in the processing steps of the invention. Furthermore, reducing the flow of fines out of the system saves on the cost of chemicals such as surfactants, enzymes and the like, because fines and short fibers which are washed out of the process and not utilized in the paper products sometimes undesirably absorb chemicals used in the process. When such fines are washed out of the system, they represent waste. Furthermore, these materials undesirably take chemicals out of the system that otherwise could be used to affect the fibers of the final product.

In the paper industry, it is well known that strength and softness usually are inversely related such that one of these two attributes can be increased or decreased only at the expense of the other. In general, debonders have been used in the papermaking process to improve the handfeel of paper products. However, debonders are known to decrease the tensile properties of the paper products, weakening the overall paper products. In some cases, surfactants and enzymes may be used to improve the Handfeel of paper products without decreasing the tensile strength to any appreciable extent. However, when enzymes or surfactants are added to the fibers, such enzymes or surfactants first attack the fines or short fibers present in the mixture due to their high surface area as compared to the longer fibers. Therefore, fines often are converted to sugars due to enzyme reaction, or may be washed out of the processing system, in a papermaking, washing or separation step. When this occurs, not all of the enzymes or surfactant result in treatment of fibers that actually remain in the sheet which is made on the paper machine. This sometimes results in a sheet that may not be as soft as it otherwise would be, or a sheet that has less strength due to the loss of fines or short fibers that could otherwise impart strength to the sheet if they were incorporated into the multilayer sheet.

In the process of this invention, it is possible to use layering technology to put fines and fibrils back on top of long fiber layers, wherein the longer fiber layers may or may not have previously been treated with surfactants and enzymes. In most cases, fibers such as recycled or virgin fibers are first pulped. After the pulping process is complete, fractionation is used to separate a given percentage of fines or fibers of specified length from the longer fibers. After the fractionation process, the longer fibers may be treated with surfactants, debonders, or a combination of surfactants and enzymes which lead to the softening of these fibers. The type of treatment of the fibers depends in most cases upon the softness and tensile requirement which is being pursued for the final product. Once the treatment is accomplished, the fibers may be taken to a paper machine where previously separated fines or short fibers and fibrils may be added on top of the longer fibers which are being formed on the twin wire former, or alternately in a multi-layer headbox. This process insures that fines are not washed out during the papermaking process, thus increasing the yield.

The processes of this invention may lead to soft fibers being used on the outside layers, with fines used on layers bearing on the inside of the paper products, thereby providing a high overall tensile strength and better softness. Furthermore, data is provided below in Table 1 showing that when the processes of this invention are applied to a two-ply paper product made from recycled old newspapers, a higher softness level may be achieved at an equivalent tensile strength.

For each papermaking process, a correlation exists between fiber coarseness and product quality in terms of product softness (or Handfeel). High quality, expensive fibers such as bleached northern kraft softwood fibers are fine and flexible and produce high quality paper products. In contrast mechanical pulping of softwoods produces high yield, coarse fibers typically used in making newsprint.

Newspapers contain a preponderance of coarse, high yield fibers, typically stone ground wood (SAW), thermomechanical (TMP), and/or chemithermomechanical (CTMP) fibers. Such coarse newsprint fibers are usually highly refined to cause fractures and fibrillations which aid in imparting strength to the resulting newsprint. Such refining changes the freeness of the coarse fibers from high freeness fibers to low freeness fibers. If such refined, coarse mechanical fibers are used in a paper product making process the resulting sheet has poor paper products properties because it is not as soft. A recent thorough explanation of the understanding of the prior art about the relationship between paper products softness and fiber coarseness is contained in Canadian patent No. 2,076,615.

Conventional recycling of old newspapers to obtain fibers comparable to the type of fibers used to originally make the newsprint is known in the art as de-inking and typically involves pulping, washing (usually with surfactants), screening, solubilizing insoluble contaminants (usually by strong caustic treatments), and washing and bleaching of the fibers to counteract the yellowing effects of caustic treatments.

One papermaking process that may be employed in this invention includes UCTAD processes. However, other former such as crescent former and twin wire former may be used as well, as known by persons of skill in the art.

The method of practicing the present invention when beginning with used newspapers broadly consists of: (1) pulping the newspaper by slurrying the newspapers in water and agitation; (2) treating the used newspaper pulp slurry with an enzyme such as a cellulase, xylanase or lipase or a combination of such enzymes and preferably in combination with a surfactant; (3) maintaining the pH of the slurried pulp below about 8.0; and (4) utilizing the slurried enzyme treated pulp as part of the furnish in a sanitary paper manufacturing process, preferably a paper products papermaking process. While screening, cleaning, flotation and some washing of the pulp slurry may be practiced prior to using it as a furnish for making sanitary paper products (e.g. paper products, towel, facial paper products or napkins) it is important that a substantial quantity of the oily contaminants be retained on the pulp after such screening, cleaning, flotation and washing.

Dyes

Recycled newsprint fibers of the present invention retain inky contaminants, and are therefore a light gray color. Paper products made with a majority of such fibers are preferably dyed to a more pleasant color. The dyes useful in this invention must be water soluble and, because of the difficulty of uniformity dying oily contaminated fibers, the dyes should be substantive to cellulosic fibers. The dyes also should be cationic, i.e. should form positively-charged colored cations when dissociated in water. Dyes are particularly well suited for dyeing mechanical and unbleached chemical pulps. Such pulp fibers contain a significant number of acid groups, with which the positively-charged cations can react by salt formation. These dyes can be selected from among the basic dyes, in which the basic group is an integral part of the chromophore, or from the newer class of cationic direct dyes, in which the basic group lies outside of the molecular resonance system. The dye is preferably added in amounts ranging from 0.01% to 3%, most usefully, at 0.05 to 0.5% on the weight of air dry fiber.

Such dyes can be applied at any normal papermaking pH, either acidic or neutral. Their excellent affinity for unbleached fiber allows them to be added to the papermaking system as late as the inlet to the fan pump, but a longer residence time, e.g., introduction at the suction side of the machine chest transfer pump would be preferred. In either case, a thick stock location with good mixing is desirable.

Enzymes

A cellulose fiber mixture or pulp suspension is typically formed from a starting material using any suitable means understood by those of ordinary skill in the art, such as mechanical pulping, thermomechanical pulping, chemical-thermomechanical pulping, bleached-chemical-thermomechanical pulping, or any variations thereof. Generally speaking, the pulping stage increases the surface area of the fibers and promotes greater fiber-to-fiber bonding and strength development, which increases the strength of the subsequently formed paper. For example, during a mechanical pulping portion of a pulping process, a refiner having rotating blades may be used to cut, split, and bruise the fibers of cellulosic material to expose greater amounts of fiber surface area. Increasing the speed of the rotating blades further reduces the cellulosic material creating greater amounts surface area, which will in turn promote the formation of stronger paper products.

While the inventors should not be held to a particular theory of operation, it is believed that an enzymatic material may be added to the cellulosic fiber mixture to lower the surface area of the individual fibers. This may be accomplished by cleaving or degrading fiber fragments, fibrils and the like from the surface of the fiber. The reduced surface area of the fiber is thought to lower the fiber-to-fiber bonding and result in a more porous, flexible, softer and/or absorbent structure or paper web.

For example, if cellulases are added to the cellulosic fiber mixture, they will typically degrade cellulose into smaller fragments, primarily glucose. Some cellulases such as endocellulase may hydrolyze the beta (1-4) bonds randomly along the cellulose chain and other cellulases such as exocellulase may cleave off glucose molecules from one end of the cellulose strand.

Hemicellulase will typically degrade hemicellulose into fragments, such as the sugars xylose, mannose, and galactose. Hemicellulase materials such as endohemicellulase randomly cleave the interior bonds of the hemicellulose chain. Many different types exist, which are specific to the different sugar backbones. Exohemicellulase systemically hydrolyze the nonreducing end of the hemicellulose chain. In particular, hemicellulase enzymes include esterase, xylase, mannase, glucuronidase, and galactase.

Cellobiohydrolase enzymes systematically cleave cellobiose from the nonreducing end of a cellulose chain, while cellobiase enzymes cleave cellobiose into two glucose molecules.

Suitable enzymes for use in the present invention are selected from the group consisting of cellulase, hemicellulase (e.g. xylanase), or lipase enzymes. Preferably one of each type is used in combination. Each type of enzyme functionally targets different components of used newspaper fibers and/or contaminants usually associated with such fibers. Cellulase enzymes contribute to ink removal by attacking the cellulose component of fibers in the proximity of ink. Xylanase and other hemicellulases attack hemicellulose components of fibers for brightness enhancement while lipase attacks resins in the fibers and in the ink formulations.

Hemicellulase is a general term describing various types of enzymes each degrading specific types of compounds commonly known as hemicellulose and found in wood and other plant materials. Xylanase is the preferred hemicellulase enzyme because it is active toward the xylan, a common type of hemicellulose. The constituents of hemicellulose differ from plant to plant. The most abundant of the wood hemicelluloses are the xylans, which are polymers of 1,4-linked β-D-xylopyranose units some of which bear short side chains such as 1,3-linked α-1-arabinofuranose units or esterified 1,2-linked α-d-glucuronic acid units. Also important, particularly in softwoods, are 1,4-β-D-glucomannans with randomly distributed glucose and mannose units, bearing side chains such as 1,6-linked α-D-galactopyranose units. Hemicellulose differs from cellulose in three important respects.

First, they contain several different sugar units whereas cellulose contains only 1,4-β-D-glucopyranose units. Secondly they exhibit a considerable degree of chain branching, whereas cellulose is a linear polymer. Thirdly, the degree of polymerization of native cellulose is ten to one hundred times greater than that of most hemicelluloses. The term hemicellulase refers to any specific enzyme class that reacts with a specific hemicellulose and as such, hemicellulase is not a specific enzyme class but a generic term of art for a group of enzyme classes. Xylanase is a specific enzyme class that attacks xylan and therefore xylanase falls within the general term hemicellulase.

Many types of enzymes can be used in the invention within classes of enzymes known as cellulase, xylanase (or other hemicellulase) and lipase. Cellulase has the most commercial choices available because it comes from many different sources, such as from *Aspergillis niger, Trichoderma reesei, T. viride, T. koningi, F. solani, Penicillium pinophilum, P. funiculosum.* It is preferred to use a cellulase that poses a endo-exoglucanase functionality to attack both amorphous and crystalline regions of cellulose so that the enzyme can attack any place on the cellulosic surface where ink is attached.

Lipase may come from *Pseudomonas fragi, Candida cylindricea, Mucor javanicus, Pseudomonas fluorescens, Rhizopus javanicus, Rhizopus delemar, Rhizopus niveus,* and various species of Miehei, Myriococuum, Humicola, Aspergillus, Hyphozyma, and Bacillus. These have both lipase and esterase activities, and they are known to degrade triglyceride in wood resin into glycerol and fatty acids. As such, the lipase enzymes may attack the vegetable oil component of the ink directly. The glycerol by-product of lipase activity may help to make the cellulose softer.

Swelling of the fiber structure improves enzyme action by assisting in the penetration of the large enzyme molecules into the fiber. Elevated temperature (e.g. above ambient and below 140° F.), use of surfactant, and acid or mild alkaline chemicals can be used in pulping newsprint to physically open up lignocellulosic fiber structures so that enzymes can better penetrate the structures and perform their respective functions. If high pulping temperatures are used, e.g. above about 140° F., the temperature must be lowered to a temperature suitable for enzyme treatment before the enzymes are added. For most enzymes, the suitable temperature is less than about 140 F.

A synergistic result is obtained with the combination of a surfactant and an enzyme. The minimum effective amount of surfactant to obtain synergy is the of surfactant needed to open up the fiber, rather than the higher levels used for solubilizing oils by emulsifying the oily contaminants. The preferred amount of surfactant is from 0.025% to 0.1% based upon the weight of fibers. Nonionic surfactants are preferred for addition to the enzyme treatment step to improve the enzymatic action for a better handfeel improvement. A preferred nonionic surfactant is commercially available as D16000® from High Point Chemical Corp. D16000 is an alkoxylated fatty acid, nonionic surfactant specifically developed for flotation type de-inking of newsprint. Other noionic surfactants well known in the art of de-inking could be used, such as; Alkyl phenyl ether of polyethylene glycol, e.g. Union Carbide Tergitol® series of surfactants; alkylphenolethylene oxide condensation products, e.g. Rhone Poulenc, Igepal® series of surfactants; aryl alkyl polyether alcohol, Rohm and Haas Triton® X-100.

In some cases an anionic surfactant may be used depending upon the contaminants present in the wastepaper. Examples of suitable anionic surfactants are: ammonium or sodium salts of a sulfated ethoxylate derived from a 12 to 14 carbon linear primary alcohol such as Vista Alfonic® 1412S, and, sulfonated napthalene formaldehyde condensates, e.g. Rohm and Haas Tamol® SN. In some cases, a cationic surfactant may be used, especially when debonding is also desired. Suitable cationic surfactants include imidazole compounds e.g., CIBA GEIGY Amasoft® 16-7 and Sapamine® quaternary ammonium compounds; Quaker Chemical Quaker® 2001; and American Cyanamid Cyanatex®.

Oil Types

Oils of the type typically used in printing, particularly printing of newspapers and in the formulation of ink for such printing, are suitable for practice in the present invention. Mineral oils and vegetable oils are the most common types of oils used in formulating printing inks for newspapers. Mineral oil, also known as white mineral oil, alboline, paraffine, Nujol, Saxol, and lignite oil, is generally classified as CAS #64742-46-7. While historically such oils may have been derived from various sources, commercially they are typically a petroleum distillate fraction with a carbon chain averaging from about 10 to about 14 carbon atoms and usually a mixture of paraffinic hydrocarbons, napthenic hydrocarbons and alkylated aromatic hydrocarbons. Such oils have a specific gravity of about 0.8 to about 0.85, a viscosity at 100° F. of 38–41SUU (Saybolt Universal Units) and an initial boiling point of about 500° F. (260° C.). Vegetable oils of the type typically used in formulating printing inks can be derived from various sources. Typical is an oil derived from soy beans known as Soya oil, Chinese bean oil, Soy bean oil, or just plain soy oil with a chemical abstract service designation CAS #8001-22-7. Such oils are saponifiable with a saponification value of about 185 to 195, a solidifying point of about 5° F. to about 18° F., a melting point of about 70° to about 90° F. and an Iodine value of about 135 to 145. Other vegetable sources of oil and other types of oil suitable for use in printing inks can also be used in the practice of the present invention.

Handfeel Test Scope

Several different lightweight, dry crepe paper products for use as standards were produced from commercially available pulp of differing. qualities for imparting softness to paper products and were used to define a numerical softness scale. A numerical value was assigned to the softness of each paper products standard. The softest product was assigned a Handfeel value of 86, and was a lightweight, dry crepe paper products produced with 50% Irving Northern softwood draft fibers and 50% Santa Fe Eucalyptus kraft pulp. The harshest product for use as a standard was produced with 100% bleached softwood chemithermomechanical pulp, (SWCTMP) and was assigned a Handfeel value of 20 on the scale. Other lightweight, dry crepe paper products samples for use as standards in defining the Handfeel Softness scale and having softness qualities between the softest and harshest paper products standards were produced from different pulp or pulp blends and were assigned Handfeel softness values between 20 and 86. The pulps used are further described in the following paragraphs. Paper products manufacturing processes other than the lightweight, dry crepe process and other pulp fibers than those used to product the standards are capable of producing paper products outside of the 20 to 86 Handfeel softness scale defined by paper products standards range of 20 to 86 for lightweight, dry crepe products is accurate and sufficient for comparative purposes.

Recycled newsprint fibers of the present invention can produce paper products having softness values higher than 86 when used in other paper products making process such as the through-dried process or when blended with other fibers.

Pulps Used to Produce Handfeel Standards (a) Bleached softwood chemithermomechanical pulp (SWCTMP) (Temcell grade 500/80) having a Canadian Standard Freeness (CSF) of 500 and an ISO brightness of 80 was made from Black spruce and Balsam fir. Pulping was with sodium sulfite pre-treatment and pressurized refining followed by alkaline peroxide bleaching to 80° ISO brightness. Kajaani coarseness of the fibers equaled 27.8 mg/100 meters and the Kajaani weight average fiber length was 1.7 mm.

(b) Bleached Northern softwood draft (NSWK) (Pictougrade 100/0-100% softwood) was made from Black spruce and Balsam fir. Pulping was by the kraft process to Kappa#=28 followed by CE DED bleaching to 88° ISO brightness. Kajaani coarseness equaled 14.3 mg/100 meters and Kajaani weight average fiber length was 2.2 mm.

(c) Bleached recycled fiber (RF) was made from sorted mixed office waste that was pulped, screened, cleaned, and washed to 550° CSF followed by bleaching with sodium hypochlorite to 80° ISO brightness. Kajaani coarseness equaled 12.2 mg/100 meters and Kajaani weight average fiber length was 1.2 mm.

(d) Bleached eucalyptus kraft pulp (BEK) (Santa Fe elemental chlorine free grade) was made from Eucalyptus Globulus pulped to Kappa#=12 by the kraft process followed by ODE D bleaching to 89° ISO brightness. Kajaani coarseness equaled 6.8 mg/100 meters and Kajaani weight average fiber length was 0.85.

(e) Bleached Southern softwood kraft (SSWK) (Scott Mobile pine) was made from Loblolly and Slash pine and pulped to Kappa#=26 followed by CEHED bleaching to 86° ISO brightness. Kajaani coarseness equaled 27.8 mg/100 meters and Kajaani weight average fiber length was 2.6 mm.

(f) Bleached Hardwood Chemithermomechanical Pulp (HWCTMP) (Millar Western grade 450/83/100) having a Canadian Standard Freeness (CSF) of 450 and an ISO brightness of 83 was made from quaking aspen. Pulping was with alkaline peroxide pretreatment and pressurized refining followed by alkaline peroxide bleaching. Kajaani coarseness of the fibers equaled 13.8 mg/100 meters and the Kajaani weight average fiber length was 0.85 mm.

Apparatus

The test method requires no particular apparatus. The test method uses the procedures and materials described below to evaluate paper products samples using a panel of ten or more people and rank softness of the samples on the softness scale using the product standards of known scale values.

Sample Preparation

1. Five samples to be tested by the panel of evaluators (judges) are selected.

2. Calculate the number of sample pads and pads of standard samples needed for the test. A panel of judges for each product to be evaluated for softness using the following equation:

$$\text{Pads needed (each product)}=(x-1)(y)$$

x=number of products to be tested
y=number of persons on the test panel

3. Randomly select a roll of sample paper products for each product being evaluated and discard the first few sheets (to get rid of the tail tying glue).
4. Prepare sample pads from each roll of product being tested. Each pad should be 4 sheets thick and made from a continuous sample of paper products that is four sheets long. Each pad is made as follows: the four sheet long sample is first folded in half. This results in a double thickness sample that is 2 sheets long. The double thickness sample is then folded in half again to produce a 4 sheet thick, single sheet long sample pad. The folding should be done so that the outside surface of the sheets when it was on the roll of paper products becomes the outside surfaces of the sheet versus the surface facing the inside of the roll then the product should be tested twice, once with the surface facing the outside of the roll as the outer surface of the sample pad and also tested with a separate sample pad prepared in which the folding results in the sheet surface facing the inside of the roll becoming the outer surface of the sample pad.
5. Make up the required number of pads from each product using the formula in paragraph 2 above. If more than one roll of a product is needed to prepare the required number of pads, then it is important that stacks of pads be randomized with product from each of the rolls. Code each pad with the batch code in the top left hand corner (on the fold).
6. Select three standards to be used as references by the panel from among the standard paper products as follows:
   First, select the coarsest sample being evaluated and compare it to standard paper products sample pads and select a lower standard that is slightly coarser than the coarsest sample.
   Next, select the softest sample of product being evaluated and select a standard paper products pad that is slightly higher (softer) than the softest sample being evaluated.
   Then, select a third standard which falls approximately in the middle of the lower and higher standards selected. The three standard paper products pads selected become the Handfeel references for the panel and define the softest, coarsest and midrange.
7. The Handfeel references bracket the softness range of the products being evaluated by the panel. For greater accuracy, the highest and lowest references selected should be approximately 30 points apart on the Handfeel Softness Scale. The middle reference should be eight or more points apart from the lower and higher references.

The Paper Making Process

The oil containing enzyme modified fibers of the present invention may be used in any commonly known papermaking process for producing, soft, bulky, sanitary paper webs such as tissue, towels, napkins and facial paper products. Many different papermaking processes including those processes wherein the web is dried by way of can drying, through drying, thermal drying, and combinations thereof are suitable. Exemplary of the types of papermaking processes which may be used in conjunction with the present invention are those processes taught in U.S. Pat. No. 3,301,746 to Sanford et al., U.S. Pat. No. 3,821,068 to Shaw, U.S. Pat. No. 3,812,000 to Salvucci et al., U.S. Pat. No. 3,994,771 to Morgan, Jr. et al., U.S. Pat. No. 4,102,737 to Morton, U.S. Pat. No. 4,158,594 to Becker et al., U.S. Pat. No. 4,440,597 to Wells et al., and U.S. Pat. No. 5,048,589 to Cook et al.

The preferred papermaking process is commonly known as the dry crepe process. Generally this process is one which uses the paper furnish of the present invention to which dry strength chemicals are preferably added to generate tensile strength, and other papermaking chemicals may be added. The paper furnish is then pumped from a machine chest and flows to a headbox and through a slice at 0.1 to 0.4% consistency onto a horizontal surface of a Fourdrinier wire through which water is withdrawn and web formation takes place. The wire cloth is entrained around a breast roll and several table rolls, then to a wire turning roll from which it is fed around a couch roll and several guide rolls back to the breast roll. One of the rolls is driven to propel the Fourdrinier wire. One or more vacuum boxes, deflectors or hydrofoils may be used between the table rolls to enhance water removal. Many different headbox designs and methods may be used. For example, in the forming of the paper web, multi-headboxes or multilayer headboxes may be used. Multi-layer headboxes are generally known to those of skill in the art.

The wet web is formed on the upper surface of the Foudrinier and transferred to a felt by pressing the web onto the felt by means of a couch roll or transferring the sheet to the felt by means of a pick-up shoe. The felt transports the web to a press assembly. The felt then moves around one or two press rolls, one of which may be a suction roll, and then is entrained around guide rolls and rotates back to the couch roll. Showers and guard boards can be used at various positions on the felt surface to assist in web pick-up cleaning and conditioning the felt surface. The press assembly comprises either a single press roll or an upper and lower press roll. Moisture is removed in the nip of the press assembly and transferred into the felt.

The formed and pressed web is transferred to the surface of a rotating drying cylinder, referred to as a yankee dryer. The drying assembly may also include a hot air hood surrounding the upper portion of the yankee cylinder. The hood has hot air nozzles which impinge on the web and assist in moisture removal. The hood includes an exhaust to remove air from the hood chamber to control temperature. The web is removed from the drying surface using a doctor blade to impart crepe to the web. To assist in removing the web from the drying surface in a controlled, uniform state, a creping adhesive is applied to the yankee dryer surface using a spray system. The spray system is a series of spray nozzles attached to a header pipe extending across the width of the dryer surface. The creping adhesive can be any of the types commonly used in paper products papermaking technology.

The paper web creped from the drying cylinder is passed through a nip formed by a pair of rolls and wound into a large roll referred to as a parent roll.

The paper products making process used can be generally characterized as a light weight, dry crepe process. A 14 inch wide pilot plant scale machine was operated as follows:

Prior to web formation the paper furnish is contained in a machine chest where dry strength additives, dyes or other chemical additives are incorporated. The paper furnish is delivered via a fan pump which flows from a headbox through a slice at 0.1% to 0.4% consistency onto the horizontal surface of a Fourdrinier wire through which water is withdrawn and web formation takes place. The wire is entrained around a suction breast roll which aids in water removal and web formation. The wire is entrained around several guide rolls and a wire turning roll and is fed back to the breast roll. One of these rolls is driven to propel the Fourdrinier wire.

The wet web is formed on the upper surface of the Fourdrinier and transferred to a felt by means of a vacuum pick-up. The felt transports the sheet to a pressure roll assembly. The felt moves around one pressure roll, a solid rubber roll, and is entrained around guide rolls and rotates back to the vacuum pick-up. Moisture is removed in the nip of the pressure roll and transferred into the felt.

In the practice of the invention, cellulosic fibers are fractionated wherein the fibers of the first cellulosic fiber mixture are separated into a second cellulosic fiber mixture and a third cellulosic fiber mixture. The second cellulolosic fiber mixture contains the short fibers, fibrils, and fines, while the third fiber mixture contains the longer fibers. The third fiber mixture is supplied to the Fourdrinier (or alternately may be used with a multi-layered headbox instead) and as applied becomes a wet paper sheet. In this invention, the slurry of the second cellulolosic fiber mixture contains the short fibers, fibrils, and fines and is applied to the upper surface of the Fourdrinier just after the paper sheet of long fibers begins to be formed, and the sheet containing the long fibers (with the short fibers, fibrils, and fines on top) is then transferred to a felt by means of a vacuum pick-up. The fines are largely absorbed into the paper sheet, and most of the fines are not undesirably passed through the mesh of the Fourdrinier wire.

The formed web is pressed and transferred to the surface of a rotating drying cylinder, commonly referred to as a Yankee Dryer. The web is removed from the surface of the Yankee at a web dryness between 95% and 96% using a doctor blade. To assist in removing the web from the dryer surface in a controlled uniform state, a creping adhesive is applied to the Yankee surface using a spray nozzle. The adhesive mixture used in the examples of this invention was a 70/30 mixture of 70% polyvinyl alcohol and 30% of a starch based latex (National Starch Latex 4441).

The paper web creped from the drying cylinder was passed through a nip formed by a pair of rolls and wound into a parent roll of desired size for testing. The paper machine formed a web 14 inches wide and ran at a reel speed of 40 to 50 feet/minute. All of the dry creped paper products samples in the examples were produced at a basis weight of 10 pounds/ream and 18–20% crepe. The samples were converted to 2-ply paper products (20 pounds/ream) for all testing.

The synergistic result from the combination of oils, coarse fibers and surfactants is demonstrated in the following Example. All proportions used herein are by weight unless otherwise specified and fiber weight is based upon the air dried weight of the fiber unless otherwise indicated.

In this invention, it is possible to build a multilayer base sheet structure which is capable of achieving a higher degree of softness at an equivalent strength compared to existing or known paper products. The structure of the paper of this invention includes a multilayer sheet which may be either a one-ply or a two-ply sheet. In most cases, the outer layers contain softer fibers and the inner layer contains fines or short fibers and fibrils which are added to the sheet for imparting tensile strength to the overall sheet structure.

The fines or short fibers that are present in an inner layer of the paper product or paper products come from the same fiber source as that of the fibers which are present in the outer layers of the paper products or paper product. That is, in one important aspect of this invention, a single furnish is used to produce the paper of the invention. In one method, the fines are separated from the pulp at an early stage in the process using a suitable fractionation device, which is capable of separating the short fibers (and fines) from the longer fibers in the pulp. The separation according to fiber length provides the option of pre-treating the longer fiber fraction with surfactant. In some cases, a combination of surfactant and enzymes may be used for treatment before the fiber fraction is provided to the paper machine. Once the fractionation has taken place, the longer fiber fraction may be treated with some kind of fiber modification or softening agent as needed based upon the requirements of the final product. Then, the fiber fraction may be transferred to the paper machine. In some cases, the short fibers or fines are fractionated early in the process or layered on top of the longer fibers, which are already proceeding along the top of the forming wire. In the case of a one-ply paper products sheet, another layer of longer fibers then may be placed on top of the layer containing short fibers, therefore constructing a three-layer single-ply paper products sheet. In other embodiments of the invention, a two-ply sheet may be provided with the original sheet being plied together in a way that the short fibers remain on a layer exposed to the inside only, while the longer fibers are contained in a layer that is exposed to the outside. This arrangement facilitates making a multilayer sheet structure with higher tensile strength, but using only a single source or furnish of fibers by utilizing the properties of the different components which are present in the pulp.

A more efficient means of using the ingredients of pulp is provided by the invention, with the ingredients that provide the most softness appearing generally on the outside of the paper products, while the ingredients that can provide strength are provided on the inner layers of the paper products. Furthermore, it is possible to reduce the costs and waste products provided in paper products manufacture by reducing the amount of fines which are lost in the processing steps of the invention. Furthermore, reducing the flow of fines out of the system saves on the cost of the chemicals such as surfactants, enzymes and the like, because fines and short fibers which are washed out of the process (and not utilized in the paper products) undesirably absorb chemicals used in the process. Thus, when they are washed out of the system, they represent waste. Furthermore, these materials undesirably take chemicals out of the system that could otherwise be used to affect the fibers of the final product.

In the paper industry, it is well known that strength and softness usually are inversely related such that one of these two attributes can be increased or decreased only at the expense of the other. In general, debonders have been used in the papermaking process to improve the handfeel of paper products. However, debonders are known to decrease the tensile properties of the paper products, weakening the overall paper products. In some cases, surfactants and enzymes may be used to improve the handfeel of paper products without decreasing the tensile strength to any appreciable extent. Enzymes are optional in this invention. However, when enzymes or surfactants are added to the fibers, they first attack the fines or short fibers present in the mixture due to their high surface area as compared to the longer fibers. Therefore, the fines often are converted to sugars due to enzyme reaction, or may be washed out of the processing system, due to a papermaking, washing or separation step in the process. When this occurs, not all of the enzymes or surfactants result in treatment of fibers that actually remain in the sheet which is made on the paper machine. This sometimes results in a sheet that may not be as soft as it otherwise would be, or a sheet that has less strength due to the loss of fines or short fibers that could otherwise impart strength to the sheet if they were incorporated into the multilayer sheet.

In the process of this invention, it is possible to use layering technology to put fines back on top of layers containing longer fibers which may or may not have been previously been treated with surfactants and enzymes. In most cases, fibers such as recycled or virgin fibers are first pulped using methods known in the art. After the pulping process is complete, fractionation is used to separate a given percentage of fines or fibers of specified length from the longer fibers. After the fractionation process the longer fibers may be treated with surfactants, debonders, or a combination of surfactants and enzymes which lead to the softening of these fibers. The type of treatment of the fibers depends in most cases upon the softness and tensile requirement which is being sought in the final product. Once the treatment is accomplished, the fibers may be taken to a paper machine where previously separated fines or short fibers may be added on top of the longer fibers which are being formed on the twin wire former. This process insures that fines are not washed out during the papermaking process, thus increasing the yield. The process of this invention may lead to soft fibers being used on the outside layers, with fines used on layers on the inside of the paper products or paper product, thereby providing a high overall tensile strength. Furthermore, data is provided below which shows that when the processes of this invention are applied to a two-ply paper products made from recycled old newspapers, a higher softness level may be achieved at an equivalent tensile strength.

The methods of selecting the panel members and the test procedures are those which are known in the art. For example, panel member selection criteria and standard instructions as provided in the specification of U.S. Pat. No. 5,582,681 to Back et al. (the "Back" patent) are hereby incorporated by reference in their entirety as if fully set forth herein. Furthermore, the panel rating scale and the Handfeel softness scale disclosed in the Back patent were used in accumulating the data provided herein.

EXAMPLE 1

A fiber mixture was prepared using recycled old newspapers which were treated with surfactants and enzymes. A two-ply paper products was constructed, and data was generated which compares a sheet structure for a double layer (DL) sheet versus a Homogenous (HG) sheet structure versus a sheet which is made with no chemicals (designated "ONP"). The paper products were constructed, and Handfeel data was generated as shown below.

TABLE 1

| GMT/BW Metric System | HF (DL S&E) Double Layer Surfactant and Enzyme | HF (HG S&E) Homogenous Surfactant and Enzyme | HF (HG No Chem) Homogenous, With No Chemical |
|---|---|---|---|
| 10 | 74 | 72 | 66 |
| 11 | 73 | 67 | 61 |
| 12 | 73 | 65 | 58 |
| 13 | 73 | 58 | 58 |
| **GMT/BW Metric System** | **HF (DLS) Double Layer; Surfactant** | **HF (HG S) Homogenous; No Surfactant** | **HF (HG No Chem) Homogenous; No Chemical** |
| 10 | 74 | 67 | 66 |
| 11 | 71 | 66 | 61 |
| 12 | 69 | 64 | 58 |
| 13 | 66 | 61 | 58 |

The samples generated which resulted in the Handfeel data shown in Table 1 consisted of a two-ply paper products, wherein each ply comprised two layers. The upper ply of the two-ply paper products comprised a long fiber layer and a short "fines" layer. The lower ply of the two-ply paper products comprised two layers, a long fiber layer and a short fines layer.

The basis weight of tissue samples vary, which affects tensile strength. In order to better compare tensile strengths from various tissue samples it is important to compensate for differences in basis weight of the samples and for machine directional differences in tensile strength. Compensation is achieved by calculating a "Basis Weight and Directionally Normalized Tensile Strength" hereinafter "Normalized Tensile Strength" or "NTS". NTS is calculated as the quotient obtained by dividing the basis weight into the square root of the product of the machine direction and cross machine direction tensile strengths. Tensile strength calculations normalized for differences in basis weight and machine direction have been devised for better comparisons of tissue samples. Tensile strengths are measured in both the machine direction and cross machine direction and the basis weight for the tissue sample is measured in accordance with TAPPI test method no. T410 om-88. When English units of measurement are used, tensile strength is measured in ounces per inch and basis weight in pounds per ream (2880 square feet). When calculated in metric units the tensile strength is measured in grams per 2.54 centimeters and the basis weight is measured in grams per square meter. It should be noted that the metric units are not pure metric units because the test apparatus used for testing tensile is set up to cut a sample in inches and accordingly the metric units then become grams per 2.54 centimeters. Using the abbreviations MDT for machine direction tensile, CDT for cross machine direction tensile and BW for basis weight, the mathematical calculation for Basis Weight and Directionally Normalized Tensile strength is (NTS) is:

$$NTS=(MDT\times CDT)^{1/2}/BW$$

NTS in English units=0.060 multiplied by the NTS in the above defined metric units.

As described in FIG. 1, the Handfeel softness shown on the y axis of the graph was greater for the paper products designated "DLSurf", which was the only sample that used fines taken and added to the top of the fibers along the paper sheet as described in this invention. That sample, which comprised a double layer or two-layer paper products having two plies, generated significantly better Handfeel results.

The second type of paper products generated was the "HGSurf" which showed a handfeel data significantly less than the DLSurf sample.

Furthermore, the paper products designated "ONP" which was a sheet which was made with no chemical additives at all, showed a lesser degree of Handfeel softness as compared to the other samples.

It is understood by one of ordinary skill in the art that the present discussion is a description of exemplary embodiments only, and is not intended as limiting the broader aspects of the present invention, which broader aspects are embodied in the exemplary constructions. The invention is shown by example in the appended claims.

What is claimed is:

1. A process of making an absorbent tissue comprising the steps of:

(a) providing a first cellulosic fiber mixture of recycled waste paper;

(b) fractionating the first cellulosic fiber mixture of recycled waste paper into:

(i) a second fiber mixture having relatively short fibers and fines, and (ii) a third fiber mixture having relatively long fibers, (c) providing the third fiber mixture to a paper machine, thereby forming a paper sheet from said third fiber mixture, and (d) adding the second fiber mixture to the upper surface of the paper sheet, and thereby forming absorbent tissue.

2. The process of claim 1 in which the third fiber mixture is treated with chemical agents to soften the fibers.

3. The process of claim 2 in which the chemical agents comprise surfactants.

4. The process of claim 2 in which the chemical agents comprise debonders.

5. The process of claim 2 in which the chemical agents additionally comprise enzymes.

6. The process of claim 1 in which the first cellulosic fiber mixture comprises recycled newspapers.

7. The process of claim 1 in which a single furnish is used as a source of the cellulosic fibers.

8. The process of claim 1 including the additional step of:

disposing of fines which are not incorporated into the paper sheet.

9. A method of making sanitary paper products suitable for use in tissues from a furnish consisting essentially of recycled waste paper containing coarse cellulose fibers, comprising:

(a) pulping said recycled waste paper in water with agitation to produce a pulp slurry furnish;

(b) fractionating the pulp slurry furnish into:

i) a slurry of short fibers and fines, and ii) a slurry of long fibers;

(c) providing the slurry of long fibers to a paper machine, thereby forming a paper sheet from said slurry of long fibers; and (d) adding the slurry of short fibers and fines to the upper surface of the paper sheet, and thereby forming sanitary paper products.

10. A method of making sanitary paper products suitable for use in tissues from a furnish, the furnish containing coarse cellulosic fibers from recycled waste paper, comprising:

(a) pulping fibers of recycled waste paper in water with agitation to produce a first pulp slurry;

(b) fractionating the first pulp slurry furnish into:

i) a second slurry of short fibers and fines, and ii) a third slurry of long fibers;

(c) adding surfactant to the third slurry of long fibers, and (d) providing the third slurry of long fibers to a paper machine, thereby forming a paper sheet from said slurry of long fibers; and (e) adding the second slurry of short fibers and fines to the upper surface of the paper sheet, and thereby forming sanitary paper products.

11. The method of claim 10 in which the paper sheet is combined with at least one other paper sheet to produce a multilayer sheet.

12. The method of claim 11 in which two layers are combined to form a two-ply tissue.

13. The method of claim 12 in which the coarse cellulosic fibers consist essentially of recycled fibers from one or more of the following fiber groups: stone ground fibers, thermomechanical fibers, and chemithermomechanical fibers.

14. The method of claim 13 in which the coarse cellulosic fibers are fibrillated.

15. The method of claim 10 which the recycled waste paper comprises newsprint.

* * * * *